US007121247B2

(12) United States Patent
Lee

(10) Patent No.: US 7,121,247 B2
(45) Date of Patent: Oct. 17, 2006

(54) SPHERICAL ROTARY ENGINE VALVE ASSEMBLY

(76) Inventor: Jung W. Lee, 1235 W. 7th Avenue, Vancouver BC (CA) V64 1B7

( * ) Notice: Subject to any disclaimer, the term of this patent is extended or adjusted under 35 U.S.C. 154(b) by 0 days.

(21) Appl. No.: 10/627,455

(22) Filed: Jul. 25, 2003

(65) Prior Publication Data

US 2004/0099236 A1 May 27, 2004

Related U.S. Application Data

(60) Provisional application No. 60/450,135, filed on Feb. 27, 2003, provisional application No. 60/432,680, filed on Dec. 13, 2002, provisional application No. 60/398,280, filed on Jul. 25, 2002.

(51) Int. Cl.
*F01L 7/00* (2006.01)

(52) U.S. Cl. ..... 123/190.8; 123/80 BA; 123/190.1; 123/190.14

(58) Field of Classification Search ..... 123/190.8, 123/48 A, 193 S, 190.1, 193.6, 80 BA, 190.14, 123/190.17, 190.4, 80 R
See application file for complete search history.

(56) References Cited

U.S. PATENT DOCUMENTS

| | | | | |
|---|---|---|---|---|
| 924,483 | A * | 6/1909 | Manuel | 123/73 A |
| 1,646,949 | A * | 10/1927 | Bournonville | 123/190.8 |
| 1,649,235 | A * | 11/1927 | Jones | 251/368 |
| 2,439,540 | A * | 4/1948 | Grubbs | 123/59.1 |
| 2,725,043 | A * | 11/1955 | Bacot | 123/41.4 |
| 3,893,483 | A * | 7/1975 | Ackerman | 137/625.21 |
| 4,010,727 | A | 3/1977 | Cross et al. | |
| 4,782,801 | A | 11/1988 | Ficht et al. | |
| 4,944,262 | A | 7/1990 | Molina et al. | |
| 4,989,558 | A | 2/1991 | Coates | |
| 5,074,265 | A * | 12/1991 | Ristin et al. | 123/292 |
| 5,908,016 | A * | 6/1999 | Northam et al. | 123/190.17 |
| 6,321,699 | B1 | 11/2001 | Britton | |
| 6,415,756 | B1 * | 7/2002 | Lee | 123/190.1 |
| 6,651,612 | B1 * | 11/2003 | Kobayashi | 123/298 |

FOREIGN PATENT DOCUMENTS

| | | |
|---|---|---|
| DE | 4017819 | 1/1991 |
| EP | 369 461 A1 | 5/1990 |

* cited by examiner

*Primary Examiner*—Tony M. Argenbright
*Assistant Examiner*—Katrina Harris
(74) *Attorney, Agent, or Firm*—Vierra Magen Marcus & DeNiro LLP

(57) ABSTRACT

A spherical rotary engine valve assembly for use in an internal combustion engine.

13 Claims, 20 Drawing Sheets

Side View

Front View

Bottom View

SPHERICAL ROTARY ENGINE VALVE ASSEMBLY

CROSS REFERENCE TO RELATED APPLICATIONS

The present application claims the benefit of the filing dates pursuant to 35 U.S.C. §119(e) of the following U.S. provisional patent applications:

U.S. Provisional Patent Application Ser. No. 60/398,280 filed Jul. 25, 2002, entitled "Force Induction Spherical Rotary Engine Valve;"

U.S. Provisional Patent Application Ser. No. 60/432,680 filed Dec. 13, 2002, entitled "Spherical Rotary Valve Engine Assembly;"

U.S. Provisional Patent Application Ser. No. 60/450,135 filed Feb. 27, 2003, entitled "Better Balanced Spherical Rotary Engine Valve With Reduced Compression And The Main Seal Design For Spherical Rotary Engine Valve."

Additionally, the present application is related to U.S. Pat. No. 6,415,756 to the present inventor, entitled, "Spherical Rotary Engine Valve," which patent issued on Jul. 9, 2002, which patent is incorporated by reference in its entirety herein.

BACKGROUND OF THE INVENTION

1. Field of the Invention

The present invention relates to automobile internal combustion engines, and in particular to a spherical rotary valve assembly for use in an internal combustion engine.

2. Description of the Related Art

Automobile manufacturers have spent billions of dollars in the past 100 years to develop better performing and more efficient engines at a reasonable cost. There are three major performance parameters in internal combustion engines. They are mechanical efficiency, indicated efficiency and volumetric efficiency. Mechanical efficiency measures frictional loss of the engine. The power loss for driving essential parts of the engine such as camshafts and oil pumps for lubrication are accounted for by friction. Indicated efficiency are thermodynamic losses.

The final parameter is volumetric efficiency. This measures the volume of ambient air drawn in per cylinder relative to the overall cylinder volume. Volumetric efficiency increases by increasing the amount of air taken in and expelled from the combustion cylinder during a piston stroke. This factor is critical to engine performance. When more air is drawn into the combustion cylinder, more fuel can be added for combustion, which increases volumetric efficiency and performance. Also, higher air intake generates more power with less rotation of the engine. Thus, greater air intake wastes less power that would otherwise be expended by burning fuel to rotate the crankshaft.

The vast majority of combustion engines today utilize spring-loaded poppet valves to control the intake of air and expulsion of exhaust gasses to and from the combustion cylinder. However, while widely used, these valves have disadvantages. First, the opening and closing of poppet valves during the intake stroke are not optimized relative to piston movement. This is shown in FIG. 1, which shows a one-half period of piston movement during the intake stroke relative to the poppet valve opening. As can be seen, at the beginning of the piston stroke while the piston is accelerating downward, the amount of air allowed in the by valve is relatively small.

Generally, during the first 20° of downward motion of the piston, the valve is only about 5 to 7% open. This disadvantageously creates a vacuum within the combustion cylinder, which can have significant adverse effects at higher engine RPM. In an optimal interaction, the valve would open up quickly, early in the piston stroke, to allow maximum air intake during the maximum downward acceleration of the piston.

Additionally, the poppet valve moves into and out of the combustion cylinder, generally along the same axis as the piston. If the timing is not controlled properly, it can occasionally happen that the piston hits the poppet valve during its motion, which contact can damage or snap off the poppet valve. Furthermore, poppet valves have a high number of intricate parts. For example, in a 4-cylinder engine with 4 valves per cylinder, the valves would have at minimum 96 parts.

Many of the disadvantages of poppet valves can be overcome by rotary valves. However, owing to problems relating to heat transfer through the valves and air flow into and out of the combustion cylinder through the valves, rotary valves have not been widely accepted. One difficulty with the use of rotary valves is the sealing of the interface between the combustion cylinder and the valve. During the compression stroke and power stroke of the piston, the rotary valve seals the top of the combustion cylinder. Attempts have been made to place a seal at the interface between the combustion cylinder and valve. The seal must be tight to prevent compressed air and gas from escaping the cylinder around the seal during the compression and/or power cycle, which leaking creates efficiency losses as well as emissions. However, as the valve is rotating in contact with the upper edges of the combustion cylinder, the contact between the rotating valve and cylinder seal must be lubricated. It is known to provide a small amount of lubricant to the seal or to provide vapor lubricant into the mixture. However, these methods introduce lubricant into the combustion cylinder, which leads to added emissions and poor combustion quality with detonation. This has been one of the biggest problems in designing rotary valves.

Self-lubricating materials are known, such as for example graphite. However, materials such as graphite generally have a maximum operating temperature in the range of 600° C. before their lubricating qualities break down. Lewis Research Center, Cleveland, Ohio produces a composite coating referred to as PS 300. PS 300 is a composite of metal-bonded chromium oxide with barium fluoride/calcium fluoride eutectic and silver as solid lubricant additives. The maximum operating temperature of this composite is 800° C. before the lubricating ability of the coating breaks down. The problem with the use of such self-lubricating materials as a seal in internal combustion cylinders is that the temperature within the combustion cylinder that would be seen by the seal far exceeds the effective operating temperature of such materials.

SUMMARY OF THE INVENTION

It is therefore an advantage of the present invention to provide a spherical rotary engine valve assembly which allows a high volume of air to enter the combustion cylinder earlier in the piston stroke.

It is another advantage of the present invention to provide a spherical rotary engine valve assembly which avoids the potential problem found in poppet valves of contact with the piston during operation.

It is a still further advantage of the present invention to provide a spherical rotary engine valve assembly which provides good thermal conductivity through the valve to avoid disparate thermal heating of the valve.

It is another advantage of the present invention to provide a spherical rotary engine valve assembly including a piston head and rotary engine valve that together provide turbulent mixing of the air and gasoline in the combustion cylinder.

It is a still further advantage of the present invention to provide a seal at the interface between the rotary engine valve and the combustion cylinder capable of establishing a tight seal within the combustion cylinder while withstanding the extreme heat within the cylinder.

It is another advantage of the present invention to provide a seal at the interface between the rotary engine valve and the combustion cylinder that utilizes the pressure of the combustion cylinder to enhance the tight seal between cylinder and valve.

It is a further advantage of the present invention to provide a piston head having a contoured surface capable of creating turbulence in the air/gasoline mixture and also concentrating the mixture into a smaller area, both of which facilitate better combustion of the mixture.

These and other advantages are provided by the present invention which in preferred embodiments relates to a spherical rotary engine valve assembly for use in an internal combustion engine. One feature of the rotary engine valve assembly is a valve having a shaped surface including at least a convex portion at the leading edge portion of valve 10 (with respect to the valve's rotation), and has a concave portion at a trailing edge portion of valve. The convex portion and concave portion abut in a joining manner proximate to the center of valve to form the shaped surface. The shaped surface has aerodynamic qualities which serve to increase the volume of air taken into the combustion cylinder.

Another aspect of the rotary engine valve assembly is a two-piece seal assembly for sealing the interface between the valve and combustion cylinder. A first ring is positioned at a top of the combustion cylinder which biases a second ring, seated atop the first ring, upward into sealing contact with the rotary valve. During the compression and combustion cycles, an added pressure will be exerted on the second ring, which will thereupon exert an increased force on the first ring to increase the sealing force of the first ring against the valve. Thus, during the compression and combustion cycles, where it is important to maintain a tight seal within engine cylinder, the two-piece seal assembly according to the present invention can create an even tighter seal. The second ring may include a lubricating coating or be formed of a self lubricating material. Largely through the isolation of the second ring from the hostile environment within the cylinder, the temperature of the lubricant on the first seal is maintained within operational levels and unnecessary friction is reduced or eliminated.

A further aspect of the rotary engine valve assembly according to the present invention is a trench formed in the valve housing. The trench prevents the back flow of gasses in the gap between the valve and valve housing from the exhaust manifold to the intake manifold. Generally, the rotation of the valve will cause air within the gap to flow in the same direction as the valve rotation. However, in the event gasses attempt to flow in the opposite direction, the gasses will be drawn into the trench where they are stopped. In addition to stopping the gasses that flow into the trench, the trench will create turbulent flow in section of the gap adjacent the trench to further hinder the flow of gasses in the improper direction.

Another aspect of the rotary engine valve assembly according to the present invention is a contoured piston head. The piston head has a shallow concave portion that conforms to the shape of the outer valve surface, and a deeper concave portion into which the air/gasoline mixture flows. As the piston moves upward compressing the air/gasoline mixture, the air/gasoline mixture will be rapidly forced from the space above the shallow concave section into the deep concave section, whereupon it is ignited by a spark plug. The forcible movement of the mixture both creates turbulence and also concentrates the mixture into a smaller area, both of which facilitate better combustion of the mixture.

BRIEF DESCRIPTION OF THE DRAWINGS

The present invention will now be described with reference to the drawings, in which.

DETAILED DESCRIPTION

The present invention now will be described more fully with reference to FIGS. 2 through 18, in which preferred embodiments of the invention are shown. The present invention may, however, be embodied in many different forms and should not be construed as being limited to the embodiments set forth herein; rather these embodiments are provided so that this disclosure will be thorough and complete and will fully convey the invention to those skilled in the art. Indeed, the invention is intended to cover alternatives, modifications and equivalents of these embodiments, which are included within the scope and spirit of the invention as defined by the appended claims. Furthermore, in the following detailed description of the present invention, numerous specific details are set forth in order to provide a thorough understanding of the present invention. However, it will be clear to those of ordinary skill in the art that the present invention may be practiced without such specific details.

Figure 2:
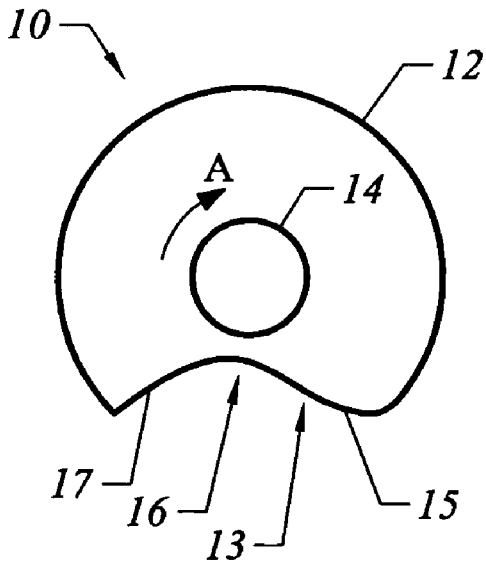
FIG. 2 is an end view of a rotary engine valve embodying the present invention, looking along its axis of rotation.
Figure 3:
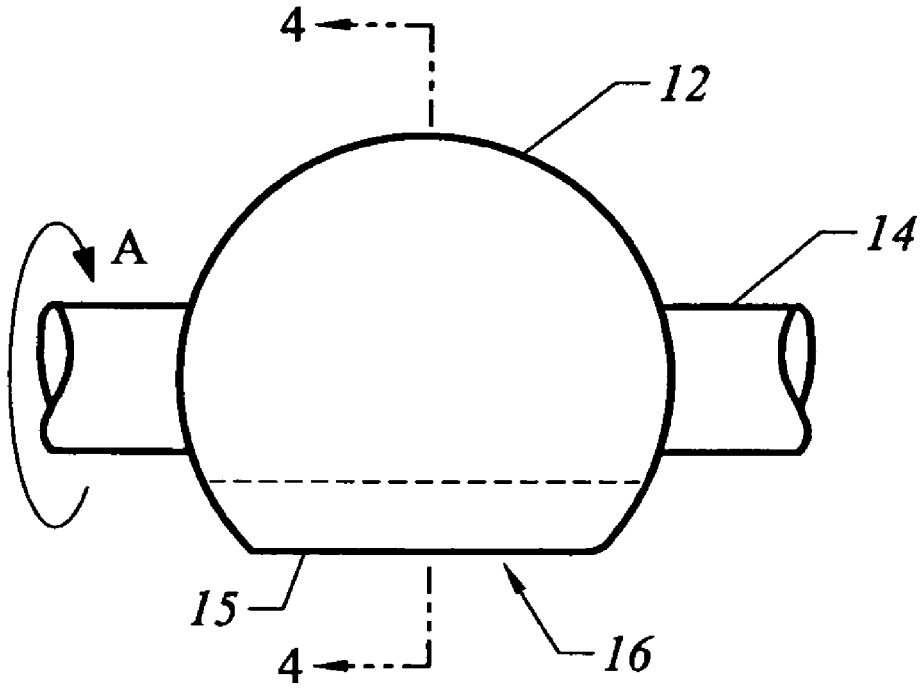
FIG. 3 is an elevation view of the rotary engine valve of FIG. 1 viewed at right angles to its axis of rotation.
Figure 4:
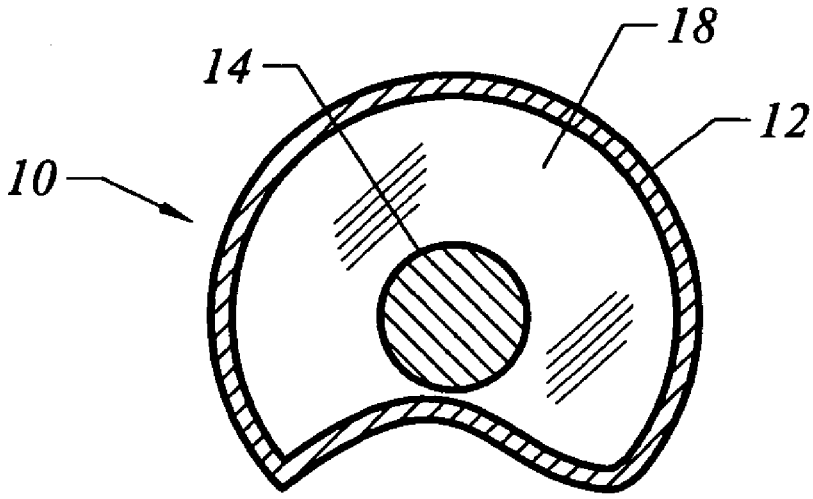
FIG. 4 is an end section view of the rotary engine valve of FIGS. 1 and 2 taken along the line III–III.

Turning to the drawings, FIGS. 2–4 illustrate the rotary engine valve 10 of the spherical rotary engine valve assembly according to the present invention. Valve 10 comprises a metallic sphere 12 that is mounted on a rotating shaft 14 for rotation thereabout according to directional arrow A. The central axis of shaft 14 passes through the center of sphere 12 for the uniform rotation of valve 10 about shaft 14.

One side of sphere 12 is truncated at 15 and includes a shaped surface 16. In various embodiments of the present invention, the shaped surface 16 may have portions that are concave, convex, pointed and/or recessed. The topography of shaped surface 16 is provided to yield advantageous results with respect to channeling air into and exhausting air out of the combustion cylinder, as well as for generating desirable air flow within the cylinder. The various topographical shapes of shaped surfaces 16, as well as their effect on the combustion process, is explained in greater detail hereinafter.

While FIGS. 2–8 may illustrate a particular topography to shaped surface 16, it is understood that the valve 10 is not limited to the particular topography shown. Specifically, the valve 10 shown in FIGS. 2–8 and explained with respect to FIGS. 2–8 may include any of the shaped surfaces 16 explained hereinafter in alternative embodiments of the present invention.

In general, the shaped surface 16 includes at least a convex portion 13 at the leading edge portion of valve 10, and has a concave portion 17 at a trailing edge portion of valve 10. Convex portion 13 and concave portion 17 abut in a joining manner proximate to the center of valve 10 to form shaped surface 16. The shaped surface has aerodynamic qualities which serve to increase the volume of air taken into the combustion cylinder.

FIG. 4 illustrates a cross-sectional view of valve 10 showing spherical element 12 as being a hollow sphere which is filled with a core 18 possessing high thermal conductivity characteristics to assist in the uniform thermal distribution of valve 10. Since valve 10 will have only a portion of its surface area repeatedly exposed to hot exhaust gasses, valve 10 will have non-uniform thermal gradients leading to non-uniform expansion of the valve. Thus, as a result of the non-uniform valve expansion, proper sealing of the valve to the engine head would be extremely difficult and possibly result in adverse blow-by of gasses within the cylinder during the power stroke and decreasing engine power and efficiency.

In one embodiment, the core 18 is a liquid salt which rapidly distributes thermal energy from one side of valve 10 to an opposite side thereby maintaining a constant thermal gradient throughout valve 10 and facilitating uniform expansion of the valve. It is understood that other liquids and compositions may be used within core 18 to distribute thermal energy in alternative embodiments. Moreover, it is understood that spherical element 12 need not be hollow, but rather be a solid metal, with only a bore sufficient to allow valve 10 to be mounted to rotating shaft 14.

Figure 5:
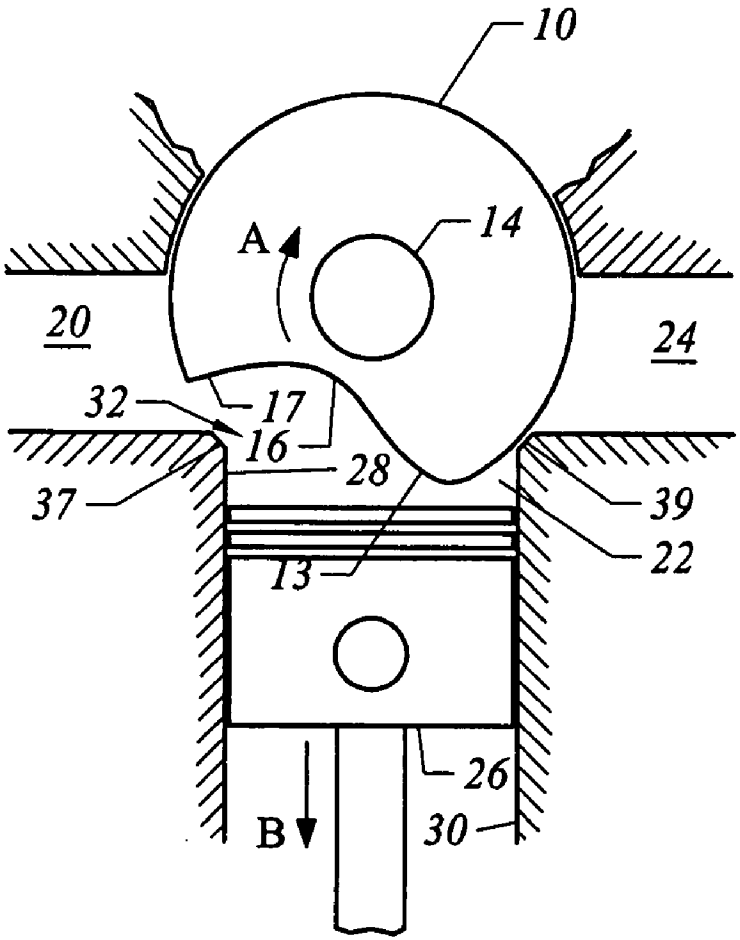
FIG. 5 is a partial sectional view of the rotary valve in an internal combustion engine and its relative position at the beginning of the intake stroke of the piston.

Referring now to FIGS. 5–8, rotary valve is seen installed in an internal combustion engine cylinder 30. FIGS. 5–8 illustrate the operational theory of rotary engine valve 10. As shown in FIG. 5, shaped surface 16 of valve 10 is substantially oriented downward facing piston 26 at the beginning of the intake stroke of piston 26 as shown by directional arrow B. As piston 26 descends in cylinder 30, valve 10 rotates clockwise to permit intake air 32 to be drawn through intake manifold 20 into combustion chamber 22. Concave portion 17 is the first to be exposed to intake port 20. The concavity of portion 17 enhances the volumetric flow of intake air from intake port 20 to cylinder 30. As the convex portion 13 rotates across the upper portion of cylinder 30, the displacement of convex portion 13 begins a slight advantageous compression of the fuel-air mixture in the cylinder prior to the cylinder compression stroke. Fuel is injected into chamber 22 above piston 26 to formulate a combustible fuel/air mixture. The injection sequences are well known in the industry and thus are not illustrated for the sake of clarity.

Figure 6:
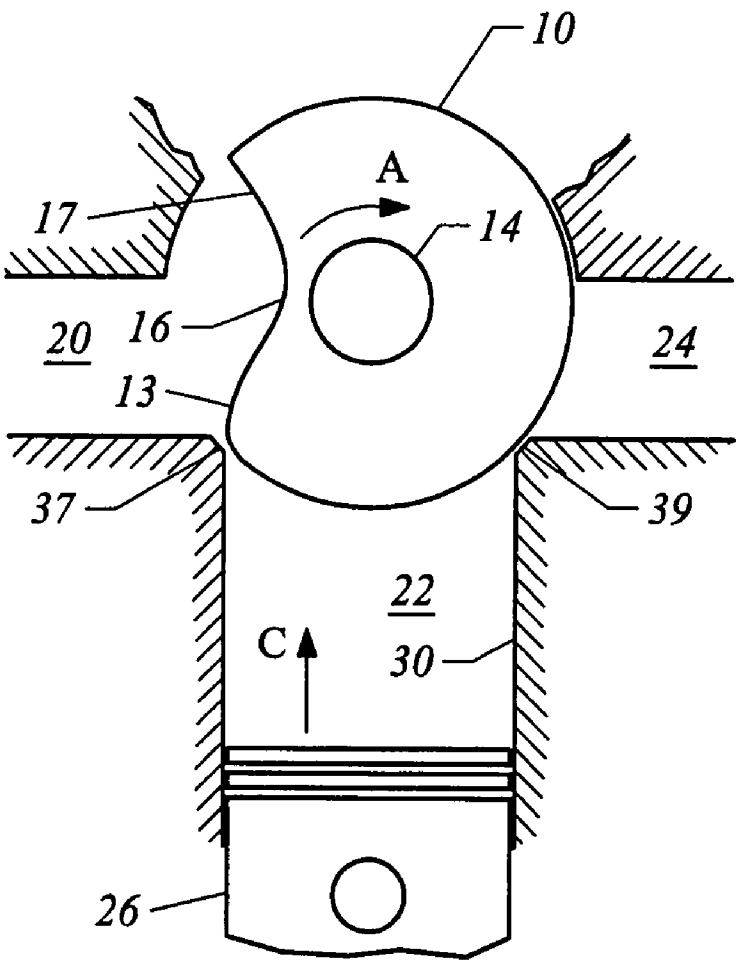
FIG. 6 is a partial sectional view of the rotary valve in an internal combustion engine and its relative position at the beginning of the compression stroke of the piston.

As shown in FIG. 6, once piston 26 reaches the bottom of its intake stroke and begins its upward travel in cylinder 30, it begins compression stroke C. At the beginning of compression stroke C rotary engine valve 10 has rotated such that the concave portion 17 and the convex portion 13 of valve 10 have rotated past intake port valve seat area 37. Spherical surface 12 of valve 10 has sealed off combustion chamber 22 from both intake and exhaust manifolds 20 and 24 at seats 37 and 39 respectively to permit the fuel/air mixture in chamber 22 to be compressed by piston 26.

Figure 7:
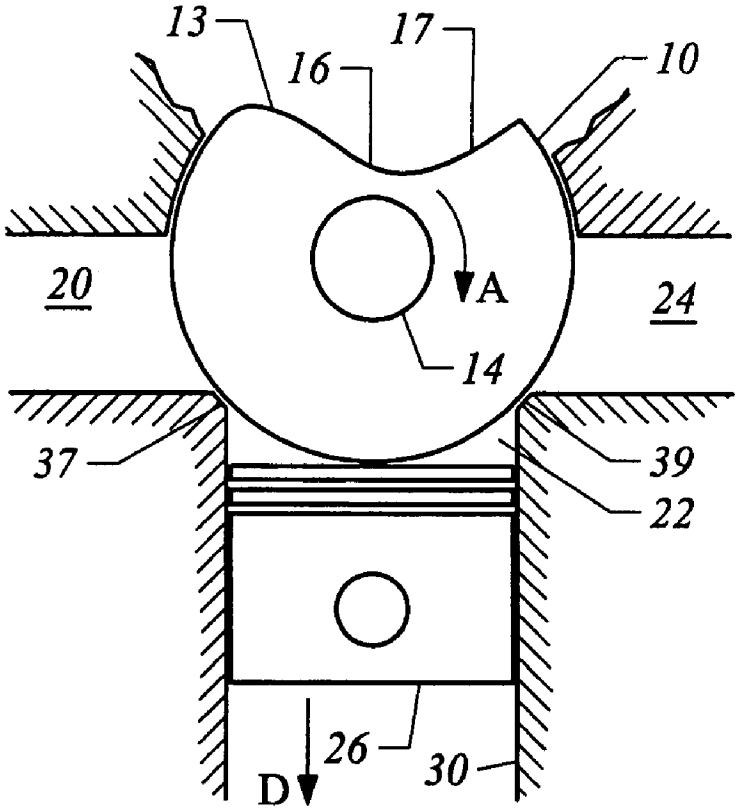
FIG. 7 is a partial sectional view of the rotary valve in an internal combustion engine and its relative position at the beginning of the power stroke of the piston.

FIG. 7 illustrates the power stroke of piston 26. As concave surface 16 continues to rotate about shaft 14, the spherical portion 12 of valve 10 maintains a sealed relationship with seat areas 37 and 39 above cylinder 30. The compressed fuel/air mixture in combustion chamber 22 is ignited by a spark plug (not shown) which begins the downward power stroke D of piston 26. Spherical surface 12 of valve 10 maintains its sealed relationship with rings 38 throughout the power stroke allowing the maximum force from the expanding gasses of the fuel-air mixture ignition to be expended on powering piston 26 downward.

Figure 8:
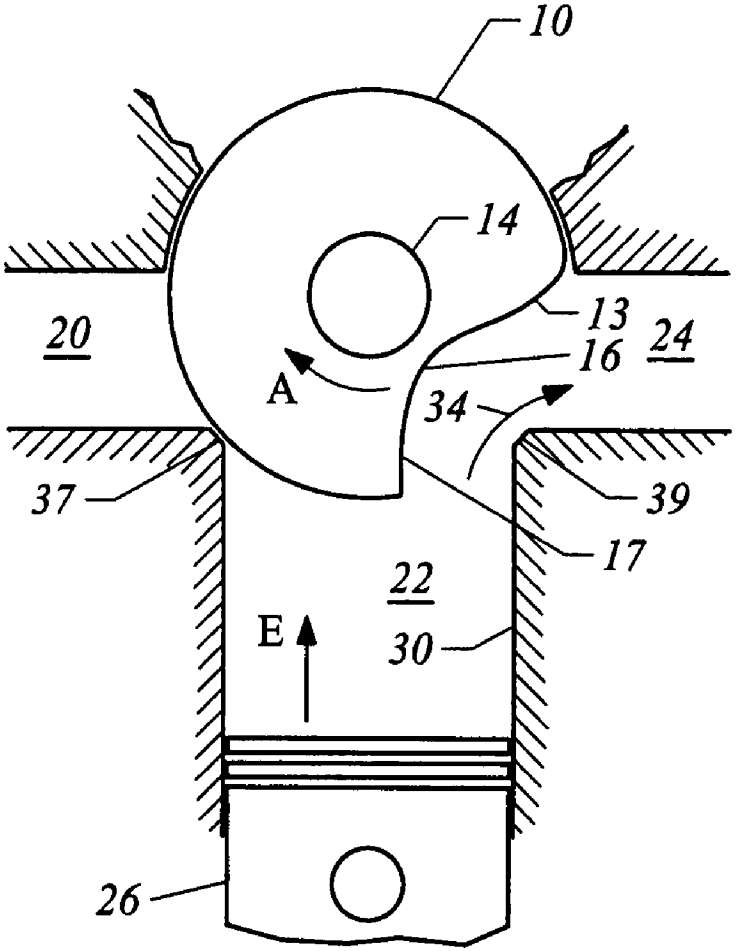
FIG. 8 is a partial sectional view of the rotary valve in an internal combustion engine and its relative position at the beginning of the exhaust stroke of the piston.

Referring now to FIG. 8, as piston 26 begins its upward exhaust stroke E, concave portion 17 of passes seat area 39 to permit the expulsion of exhaust gasses. The concave form of portion 17 facilitate a rapid opening of maximum area to permit an easy flow of exhaust gasses 34 from combustion chamber 22 to exhaust manifold 24. The increase in area to exhaust manifold 24 results in less power expended by the engine to force exhaust gasses 34 into manifold 24, thereby improving the efficiency of the engine. Thus, rotary engine valve 10 completes one revolution for each firing cycle of piston 26.

A single rotating valve such as valve 10 can replace the complex and expensive assemblies in modern engines of cam shafts, lifters, and the multiple number of valves in each engine cylinder, typically four valves per cylinder. Additionally, since the valve surface is always above the top surface of the piston at top dead center, there is no danger of damaging a piston, or crank shaft should a valve fail, which is typically the case in current engines where valve heads when operating are displaced into the combustion chamber to open the ports to the desired manifolds.

The volumetric intake of air to cylinder 30 can be controlled and optimized by varying the shape of convex and concave surfaces 13 and 17 by varying the width, depth, and geometry of the shaped surface form. Since shaped surface 16 does not contact any portion of the engine there are no restrictions on its configuration. The geometry of surface 16 and its rotational synchronization with piston 26 can be adjusted such that the intake occurs at an advanced position before top dead center of the piston and the exhaust valve opening can be retarded before bottom dead center by varying the valve size and the size of surface 16 to optimize the efficiency and power output of the engine.

Figure 9A:
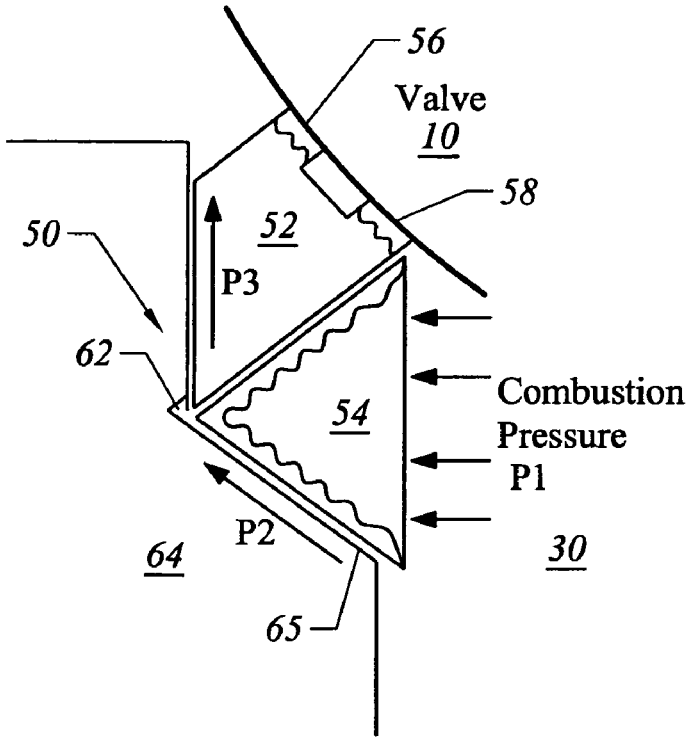
FIG. 9A is a view of area VIII of FIG. 8 showing the sealing of the valve on the engine cylinder.
Figure 9B:
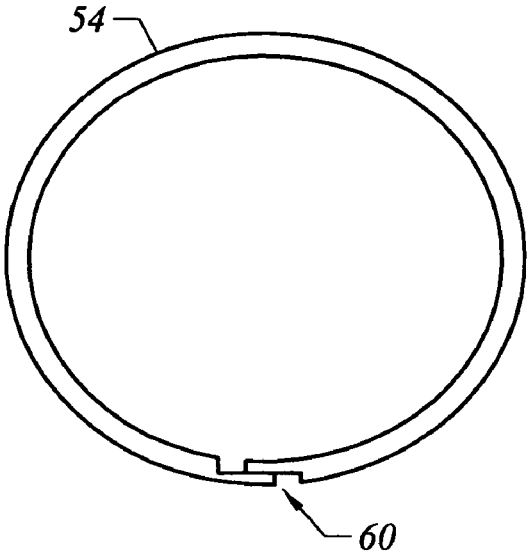
FIG. 9B is a portion of the seal shown in FIG. 9A in an expanded position.
Figure 9C:
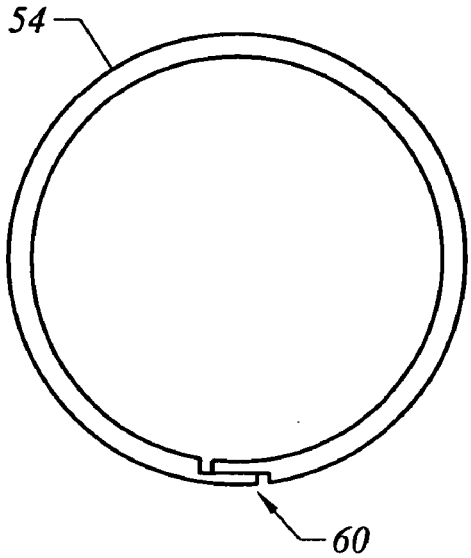
FIG. 9C is a portion of the seal shown in FIG. 9A in a compressed position.

Referring now to FIGS. 9A and 9B, the valve assembly according to the present invention includes a two-piece seal assembly 50 for sealing an interface between the valve 10 and the engine cylinder 30. The valve comprises a first annular ring 52 and a second annular ring 54 mating therewith as explained hereinafter. The two-piece seal assembly is capable of accommodating any fluctuation of the cylinder pressure. Ring 52 is a closed annular ring having a cross-sectional shape as shown in FIG. 9A. The ring 52 is positioned to maintain a constant sealing contact with the rotating valve at points 56 and 58. The contact points may have a self-lubricating coating, such as PS300 described above. It is understood that the points of contact or the entire ring 52 may be formed of other materials, such as graphite, known to have low friction in alternative embodiments.

Ring 54 is provided to bear against ring 52, as well as to shield ring 52 from the heat within the combustion cylinder 30. Ring 54 is generally annular and has a cross-sectional shape as shown in FIG. 9A. The ring 54 may preferably be formed of a material having low thermal conductivity, such as for example carbon steel. Ring 54 further includes a gap 60 along its length. In an unbiased position, shown in FIG. 9B, the ring 54 uncoils somewhat so that the ends of the ring at gap 60 are slightly spaced from each other. During assembly of the valve assembly, the ring 54 is compressed slightly (i.e., the ends at gap 60 are brought closer together) and fit into an annular rim 62 (FIG. 9A) formed at the top of the cylinder wall 64. Thus, the ring 54 is preloaded with an outward bias against an inclined surface 65 of rim 62.

After ring 54 is seated within rim 62, ring 52 is positioned on top of ring 54 as shown. When the valve is pressed into place, ring 52 will press down on ring 54 and the inclined surfaces of the ring 52 and rim 62 compress the end portions of ring 54 further together to the position shown in FIG. 9C. With the rings 52, 54 and valve 10 so positioned, the ring 54 biases ring 52 upward into close sealing contact with the valve 10.

During the compression and combustion cycles, a pressure will be exerted by the compressed gasses on ring 54 in the direction arrows P1 as shown. To the extent ring 54 moves at all as a result of this pressure (it may not), the pressure forces the ring 54 up the inclined surface 65 in the direction of arrow P2. Such movement in turn pushes the ring 52 upward in the direction of arrow P3 into tighter contact with the valve 10. Thus, during the compression and combustion cycles, where it is important to maintain a tight seal within engine cylinder 30, the two-piece seal assembly 50 according to the present invention can create an even tighter seal. Also, largely through the isolation of seal 52 from the hostile environment within the cylinder 30, the temperature of the lubricant is maintained within operational levels and unnecessary friction is reduced or eliminated.

Valve timing determines the size ratio between cylinder and the valve. The diameter of the valve sphere has to be big enough to close up the combustion chamber during both compression and power cycles.

Figure 10:
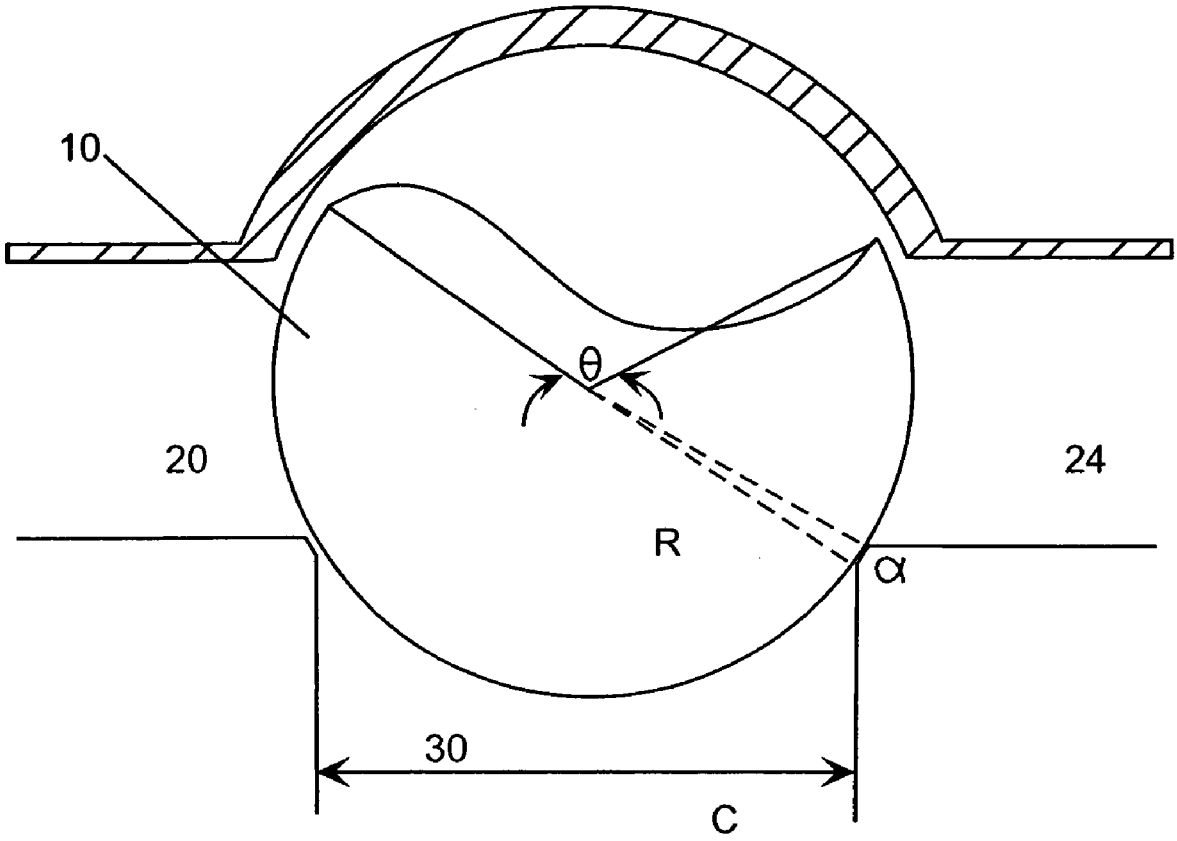
FIG. 10 is a partial sectional view of the rotary valve in an internal combustion engine showing the geometric parameters.

The relationship between diameter of the cylinder and the radius of the valve can be formulated with predetermined intake valve opening and exhaust valve opening positions. Referring to FIG. 10, the radius of the valve, R, can be given by the following equation:

$$R=C/2\cos((IVO-EVO+180+2\alpha)/4),\text{ where:}$$

IVO=intake valve opening position (in degrees before top dead center),

EVO=exhaust valve opening position (in degrees before bottom dead center), $\alpha$=seal contact width expressed in degrees from the center of the valve, and C=diameter of the engine cylinder.

By way of an example only, for:

intake valve opening position=24° (BTDC), exhaust valve opening position=60° (BBDC), $\alpha$=2.5°, and cylinder diameter=4 in., $$R=4\text{ in.}/2\ \mathrm{Cos}((24°-60°+180°+2\times2.5°)/4)$$

$$R=2.512\text{ in.}$$

It is understood that each of these values may vary in alternative embodiments according the relationship set forth above.

In the spherical rotary engine valve according to the present invention, both intake and exhaust valves duration are preferably the same, unless variable valve timing is applied, because they share same air passage of the valve. As used herein, "duration" of the valve refers to an angle, represented as $\theta$ in FIG. 10, taken with respect to the center of the valve over which the valve is open and through which gas can flow. The valve duration $\theta$ is one half of the actual valve duration, since valve rotates in a half speed of crankshaft. However, due to the width of the main seal, 2α has to be added to actual valve duration before it can be divided.

Therefore, valve duration is given by the relationship:

$$\theta=(D+2\alpha)/2, \text{ where:}$$

D Actual duration of the valve, and

α=Seal contact width expressed in degrees from the center of the valve.

By way of an example only, for:

D=260°, and

α=2.5°, $$\theta=(260°+2\times2.5°)/2$$

$$\theta=132.5°$$

It is understood that each of these values may vary in alternative embodiments according the relationship set forth above.

Figure 11A:
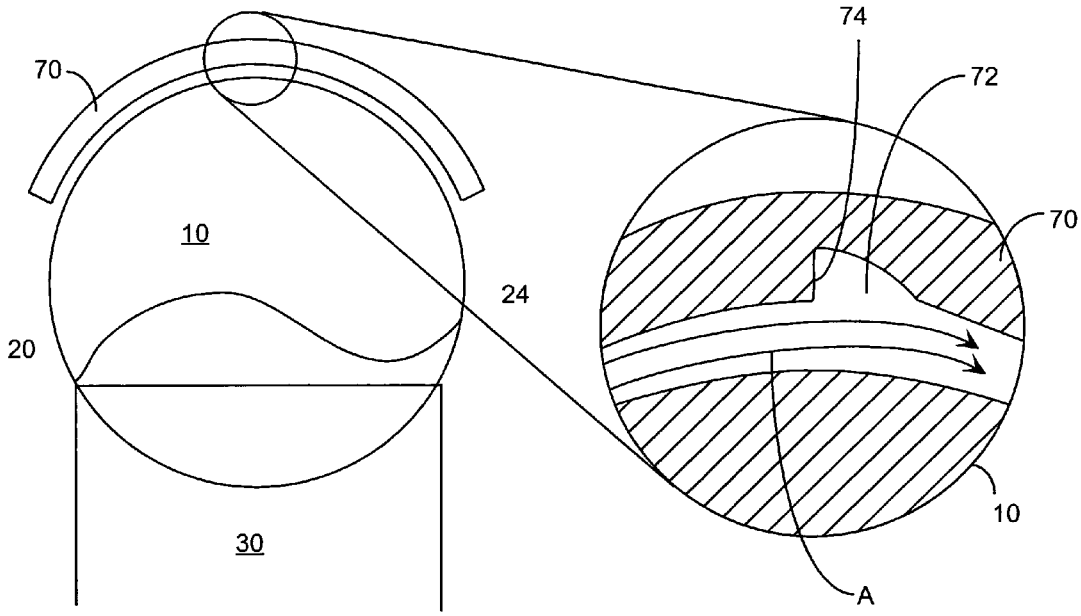
FIG. 11A is a partial sectional view of the rotary valve in an internal combustion engine including an enlarged view of a gap between the rotary valve and a valve housing adjacent thereto.
Figure 11B:
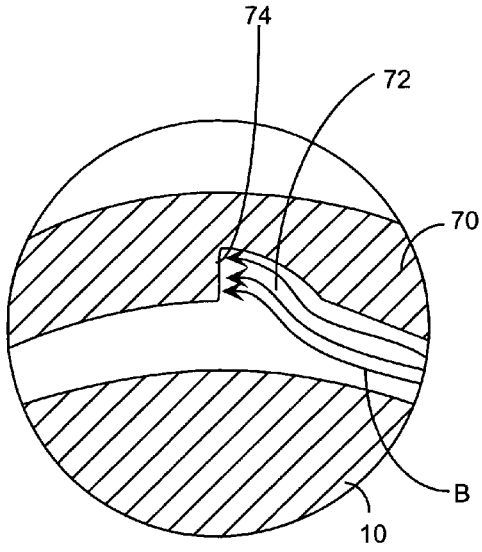
FIG. 11B is an enlarged view of the gap between the rotary valve and the valve housing shown in FIG. 11A with gas flow in the opposite direction.
Figure 11C:
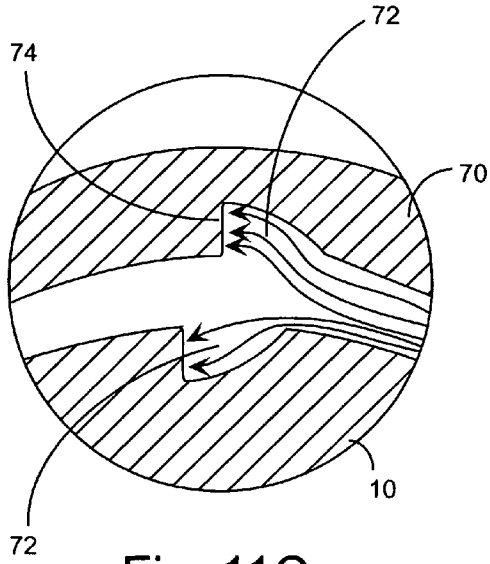
FIG. 11C is an enlarged view of the gap between the rotary valve and the valve housing shown in FIG. 11A with gas flow in the opposite direction according to a further embodiment of the invention.

FIGS. 11A–11C illustrate a further mechanism for affecting a seal between the intake and exhaust manifolds for preventing the flow of gasses directly therebetween. In particular, it is desirable to prevent the flow of exhaust gasses from the exhaust manifold 24 directly to the intake manifold 20. This is generally prevented as a result of air flow in gap between the valve 10 and the valve housing 70 in the direction of arrows A shown in the enlarged section of the gap in FIG. 11B. The gap between the valve and valve housing is provided to be sufficiently small so that, generally, the rotation of the valve in the clockwise direction will cause airflow in the gap to similarly travel in the clockwise direction in the direction of arrows A.

However, it is possible that the width of the gap will vary, due for example to uneven thermal expansion between the valve and valve housing so that the air flows in the opposite direction—in the direction of arrows B in FIG. 11B. It may also happen that the air pressure at the intake side may be sufficiently less than the air pressure at the exhaust side that the pressure differential overcomes the effects of valve rotation on the gasses in the gap so that the gasses flow in the direction of arrows B.

Therefore, in accordance with another aspect of the present invention, the valve housing 70 may be formed with a trench 72 running generally parallel to the axis of rotation of the valve 10. The trench is a generally recessed section having a wall 74 which is provided at an abrupt angle with respect to the gap between the valve and valve housing. In embodiments of the present invention, this angle may be approximately 90°, however, it is understood that this angle may be greater or lesser than that in alternative embodiments.

When air is flowing through the gap in the proper direction as shown in the enlarged view of FIG. 11A, trench 72 has no effect on the airflow. However, when gasses attempt to flow in the improper direction of arrows B shown in enlarged view of FIG. 11B, the trench has the effect of drawing the gasses into the trench, where they are stopped by wall 74. In addition to stopping the gasses that flow into the trench, the trench will create turbulent flow in section of the gap adjacent the trench to further hinder the flow of gasses in the improper direction. While one such trench 72 is shown in the valve housing in FIGS. 11A and 11B, it is understood that more than one such trench may be provided in the valve housing wall.

In a further alternative embodiment shown in FIG. 11C, in addition to the trench formed in the valve housing 70, the valve 10 may similarly include one or more trenches 72 formed in its outer surface that are oriented and configured similarly to the trench 72 formed in the valve housing 70. Such trenches 70 formed in the outer surface of the valve 10 operate in the similar manner as described above to prevent the flow of gasses in the direction of the arrows B.

Figure 12A:
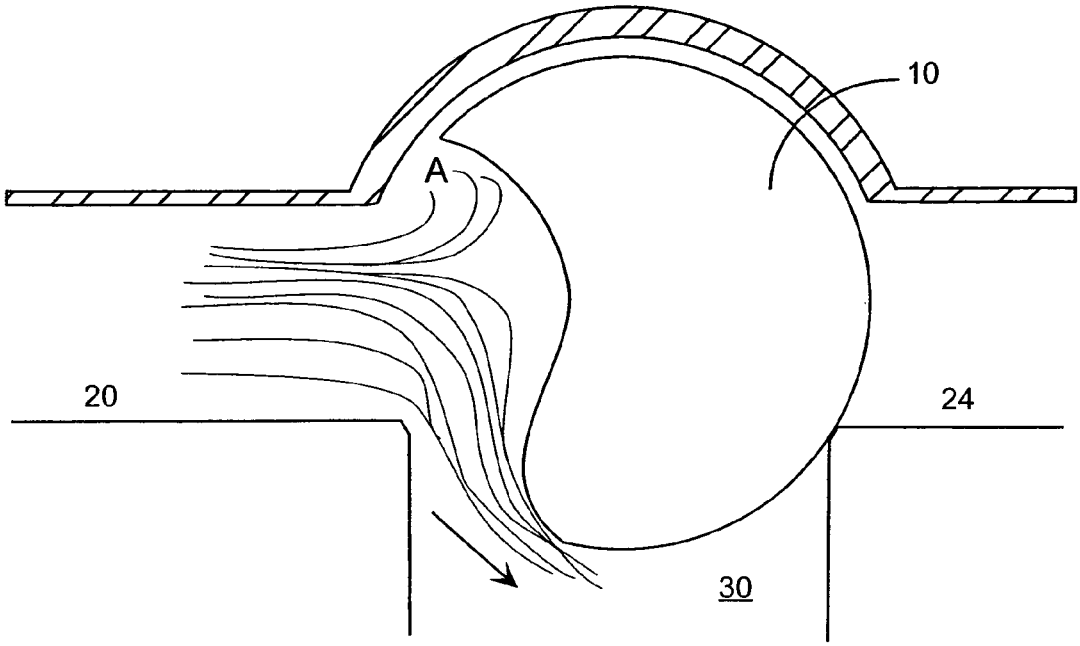
FIG. 12A shows possible airflow through the spherical rotary valve where air is drawn into a low pressure area A.

FIG. 12A illustrates an air stream in the air passage of the valve during the induction cycle. When the valve rotates to a point near closing of the intake manifold 20, concave portion of the valve is positioned along the housing of the valve. It is possible in some circumstances that this will create suction in the area A on FIG. 12A which acts to redirect some of the air stream from the intake manifolds away from entering directly into the engine cylinder 30.

Figure 12B:
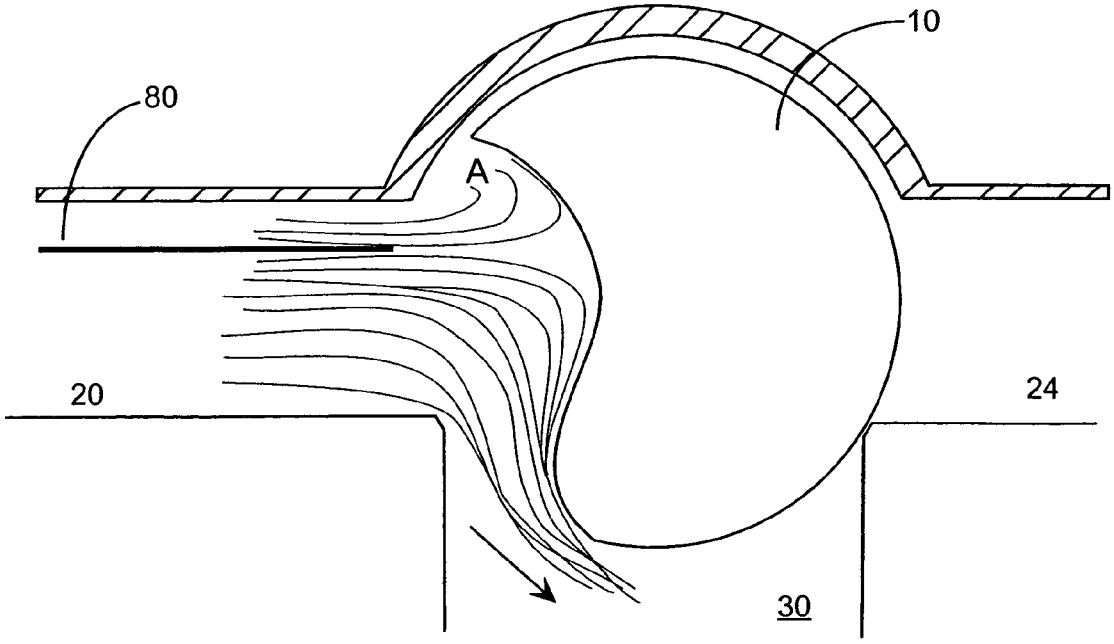
FIG. 12B shows an alternative intake manifold design with a separate air runner to supply air to low pressure area A.

Therefore, in an alternative embodiment of the invention shown in FIG. 12B, the intake manifold may include an extra air runner 80 feeding extra air to the point A. The buildup of pressure at point A due to the extra air runner 80 prevents air from being diverted from entering the engine cylinder 30.

With a duration of the valve of the above example of 132.5°, there is no risk of exposing the extra air runner 80 to the exhaust manifold 24. However as duration increases, the risk of exposing extra air runner 80 and exhaust runner to free flow between the runners. With an aggressive design of the duration, another provision may be needed to avoid this risk.

Figure 13A:
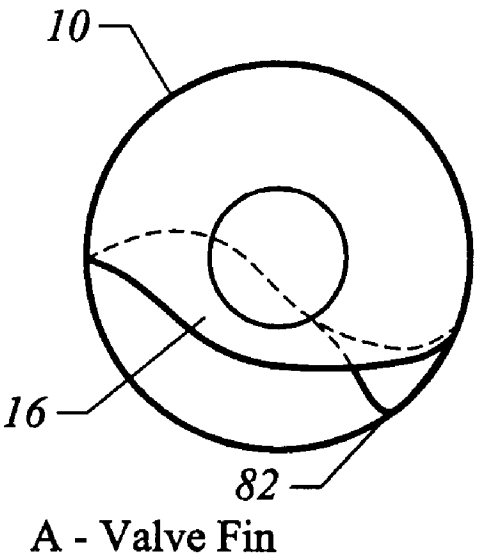
FIGS. 13A–13C are side, front and bottom views, respectively, of an alternative spherical rotary valve design including a fin for sealing the separate air runner shown in FIG. 12B.
Figure 13B:
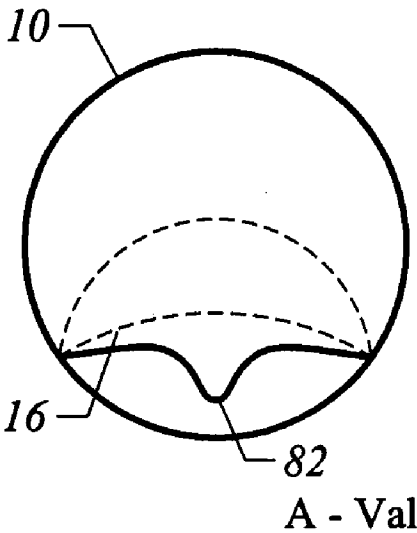
Figure 13C:
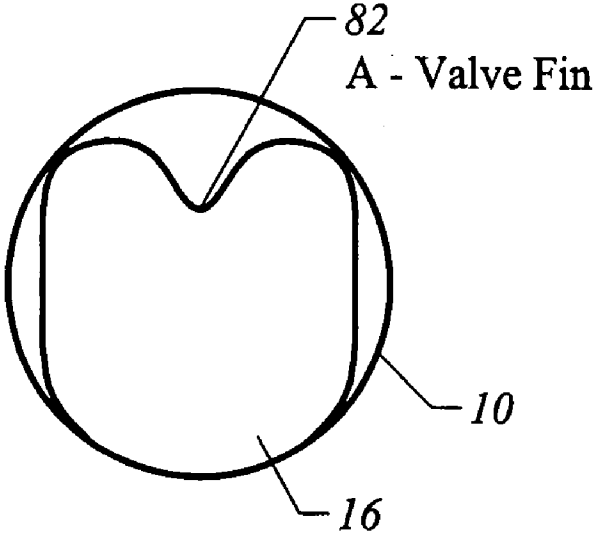

Thus, as shown in FIGS. 13A–13C, a valve fin 82 may be added to the existing valve. For aggressive designs with large durations, the valve fin 82 covers the air runner 80 of the intake manifold when the shaped surface 16 is open to the exhaust manifold.

When the air and gasoline mixture is compressed within the cylinder 30, it is important to obtain turbulent flow as the piston rises to top dead center. This is because for an engine running at 3000 RPM for example, the combustion time is only about 10 ms. Unless the there is turbulent mixing of the air and gas within the chamber, not all of the air and gas will combust within the required time, thereby greatly reducing engine efficiency.

Figure 14A:
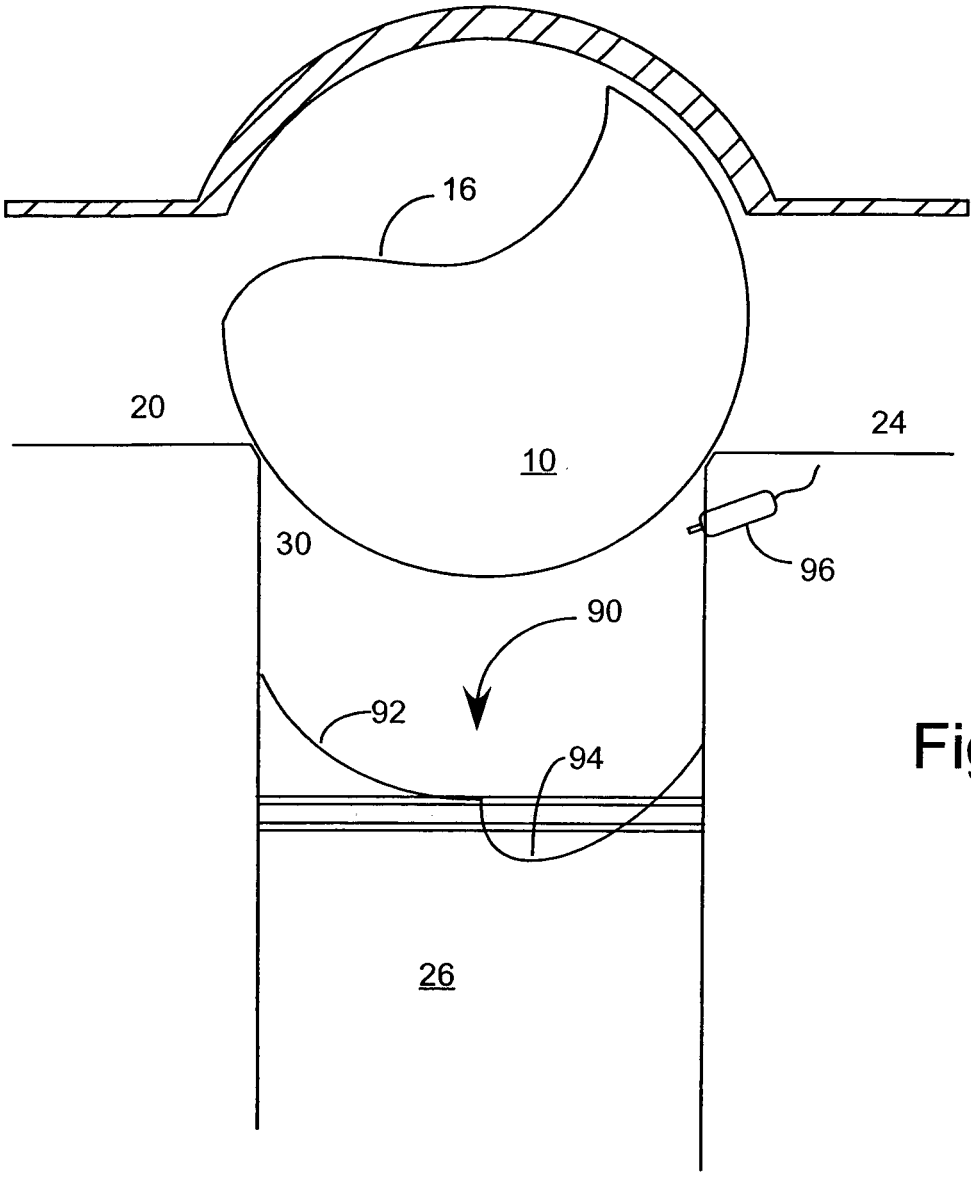
FIGS. 14A and 14B are partial sectional views a spherical rotary valve assembly according to the present invention including a contoured piston head.
Figure 14B:
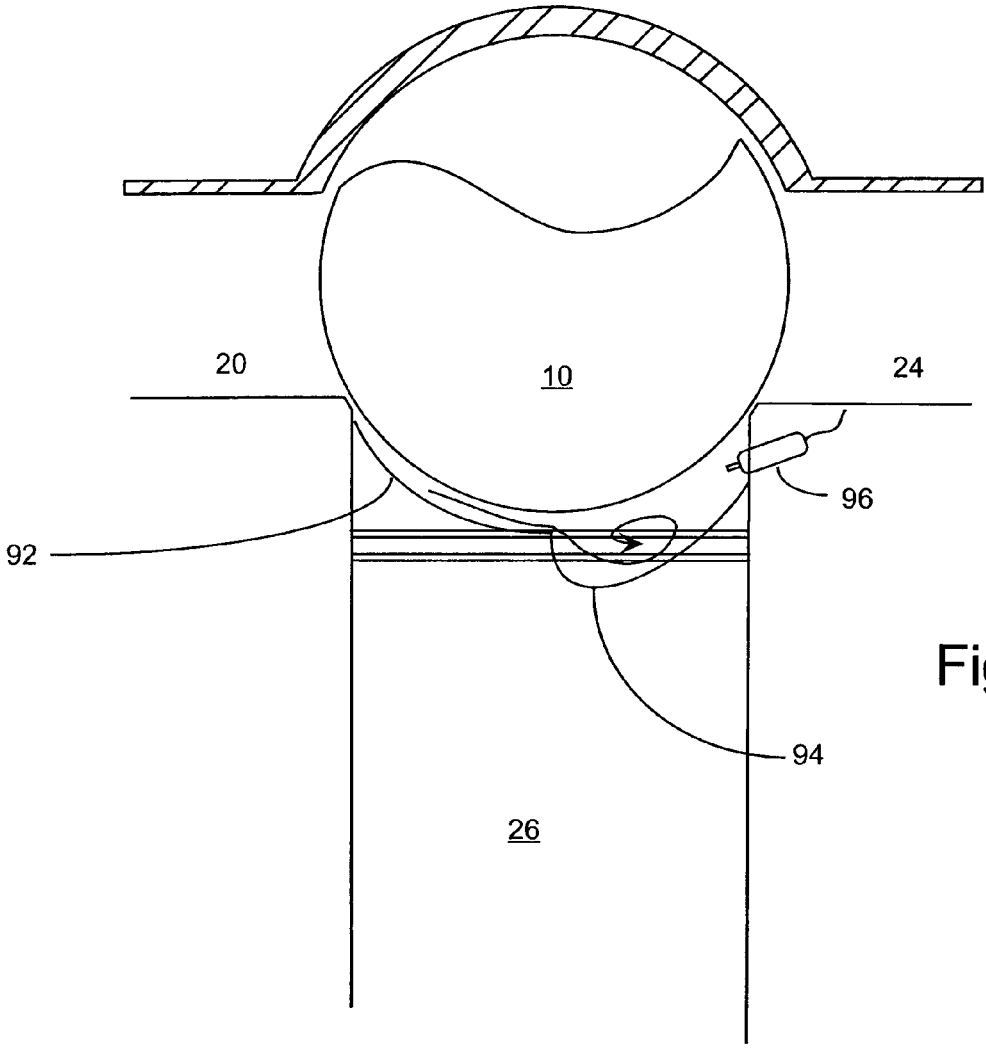
Figure 14D:
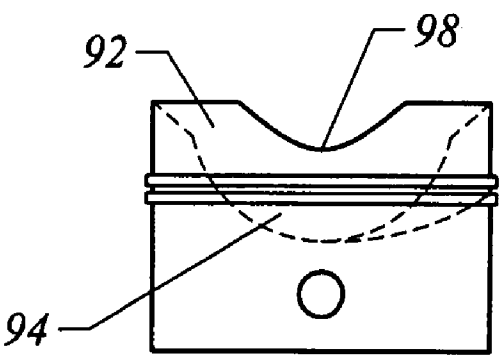
FIGS. 14C–14E are side, front and bottom views, respectively, of the contoured piston head shown in FIGS. 14A and 14B.
Figure 14E:
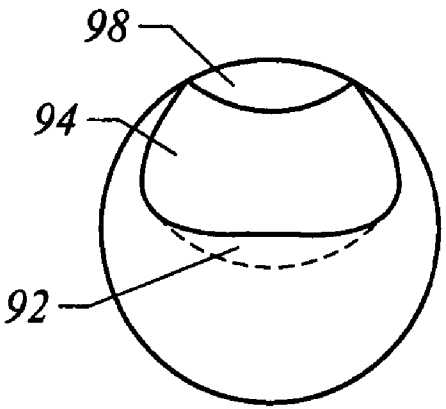
Figure 14C:
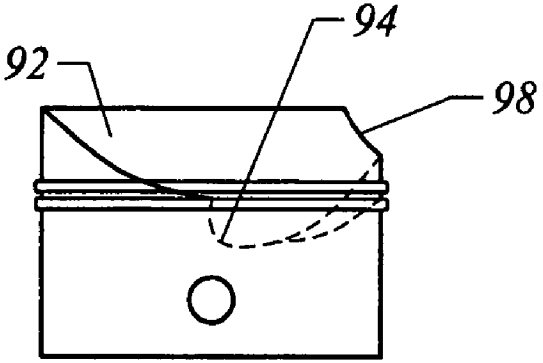

Therefore, in accordance with a further feature of the present invention, the piston head of the rotary engine valve assembly according to the present invention preferably includes a piston having an upper surface having a contour that maximizes turbulent mixing of the air/gasoline mixture within the cylinder. In particular, referring to FIGS. 14A–14E, the piston 26 according to the present invention includes a contoured piston head 90 having a shallow concave section 92 and a deep concave section 94. The shallow concave section 92 generally conforms to the outer spherical surface of the valve 10. As the piston moves upward compressing the air/gasoline mixture from the position shown in FIG. 14A to the position shown in FIG. 14B, the air/gasoline mixture will be rapidly forced from the space above the shallow concave section 92 into the deep concave section 94, whereupon it is ignited by the spark plug 96. The forcible movement of the mixture both creates turbulence and also concentrates the mixture into a smaller area, both of which facilitate better combustion of the mixture. As best seen in FIGS. 14C–14E, the contoured piston head 90 may further include a recess 98 in which may be positioned the spark plug 96 when the piston is at top dead center.

Figure 1:
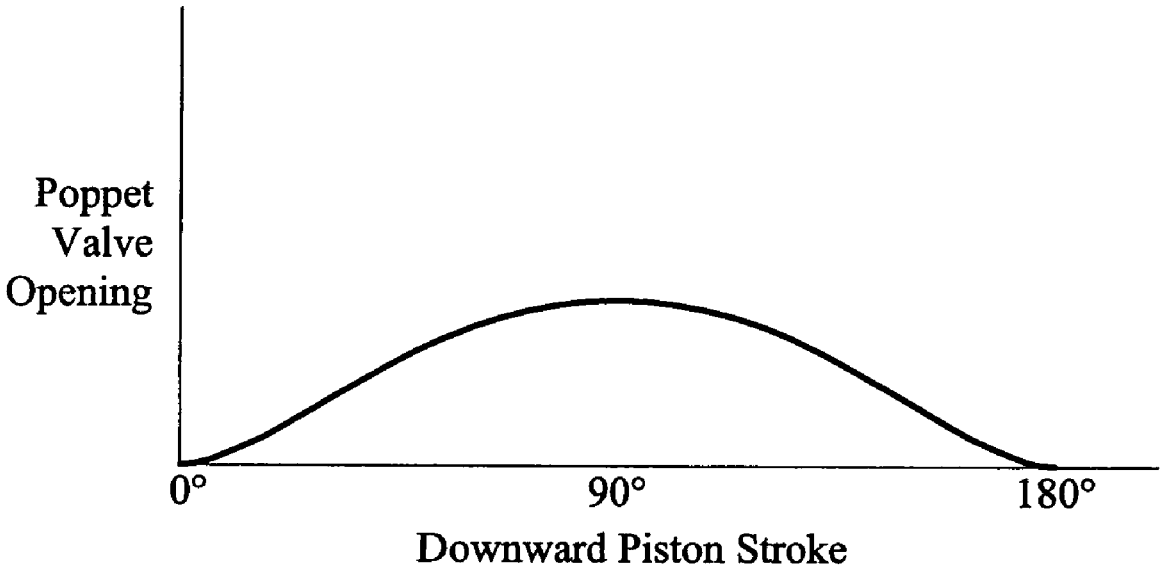
FIG. 1 (Prior Art)
FIG. 1 is a graph of the motion of a prior art poppet valve relative to the downward stroke of the piston.
Figure 15:
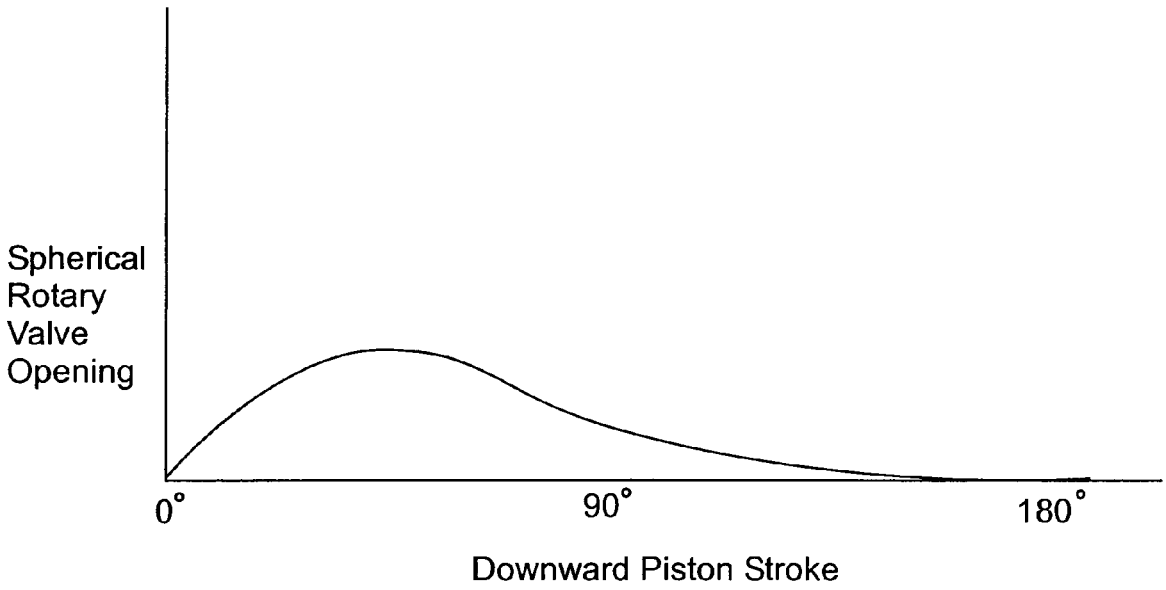
FIG. 15 is a graph showing the spherical rotary valve opening area relative to piston movement.

Referring again to the shaped surface 16, the convex leading edge and concave trailing edge provide several advantages. FIG. 15 shows a one-half period of piston movement during the intake stroke relative to rotation of the spherical valve according to the present invention. Unlike the poppet valve shown in prior art FIG. 1, the spherical rotary engine valve having the shaped surface 16 opens to a maximum at about 25% into the duration, when the piston's downward acceleration is at its peak. Then, the valve comes to a close at a gentle pace. This is not possible with conventional poppet valves.

Figure 16A:
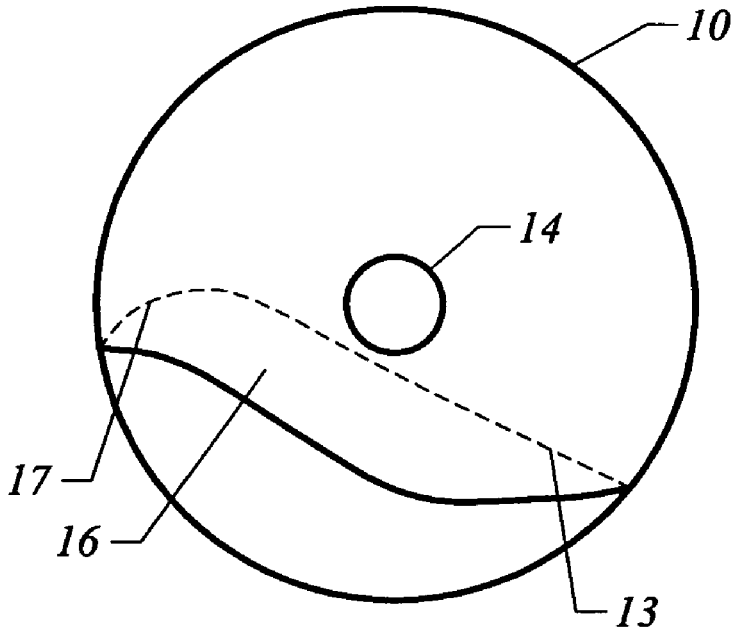
FIGS. 16A–16C are side, front and bottom views, respectively, of an alternative embodiment of the shaped surface of the spherical rotary valve according to the present invention.
Figure 16B:
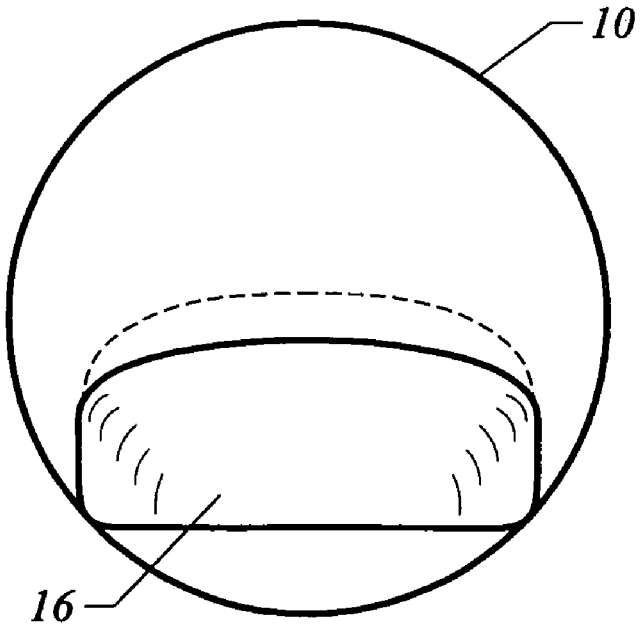
Figure 16C:
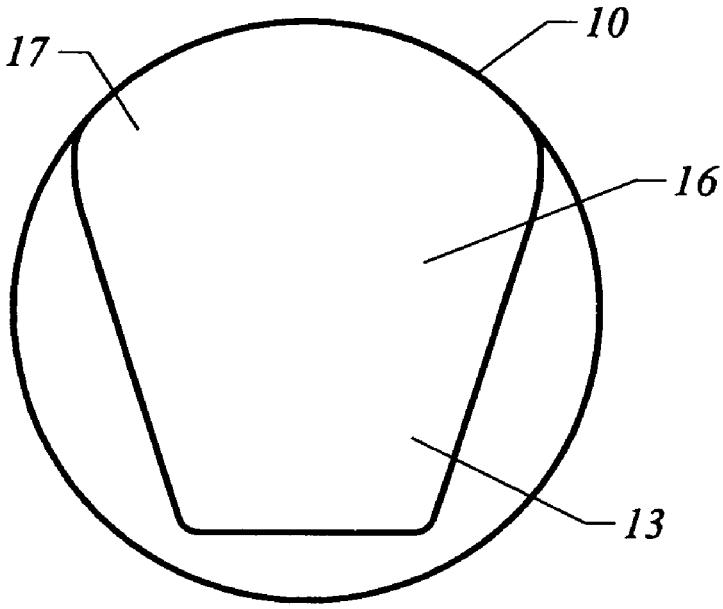

While a preferred embodiment of the shaped surface 16 has been described above, it is understood that further alternative topographies of shaped surface 16 may be provided in accordance with the present invention. For example, as shown in FIGS. 16A–16C, in addition to the convex/concave topography of shaped surface 16 explained above, the shaped surface may further include sidewalls so that the convex/concave surface is formed within a recess in the valve 10. Moreover, the sidewalls of the recessed area slope inward. Thus, at the start of a stroke (as shown in FIG. 5), the concave portion 17 is relatively wide. As the valve 10 rotates on shaft 14, the width of the shaped surface 16 between the sidewalls becomes more narrow, to its narrowest dimension at convex portion 13.

Even without the recessed section shown in FIGS. 16A–16C, the convex/concave topography of shaped surface 16 compresses the intake air toward the end of the valve stroke. However, the effect of the topography of shaped surface 16 shown in FIGS. 16A–16C is to further compress the air as it enters the cylinder 30. It is known to inject compressed air into a combustion engine cylinder to increase the overall volume of the air and gas mixture to be combusted. This is referred to as supercharging, and it improves an engine's overall performance. Conventionally, it is known to use centrifugal pumps for supercharging. It is not known to accomplish supercharging with the valve itself, as disclosed above.

Figure 17A:
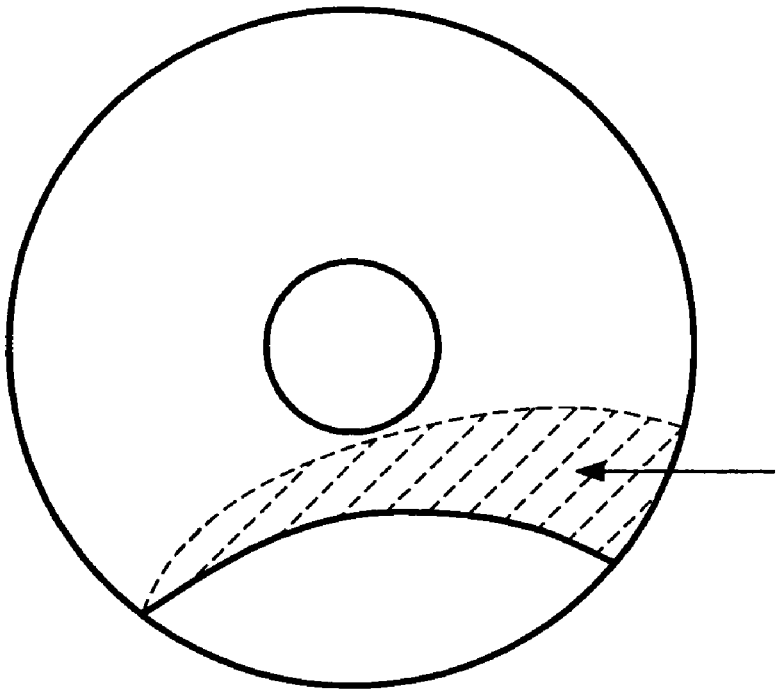
FIGS. 17A–17C are side, front and bottom views, respectively, of an alternative embodiment of the shaped surface of the spherical rotary valve according to the present invention.
Figure 17B:
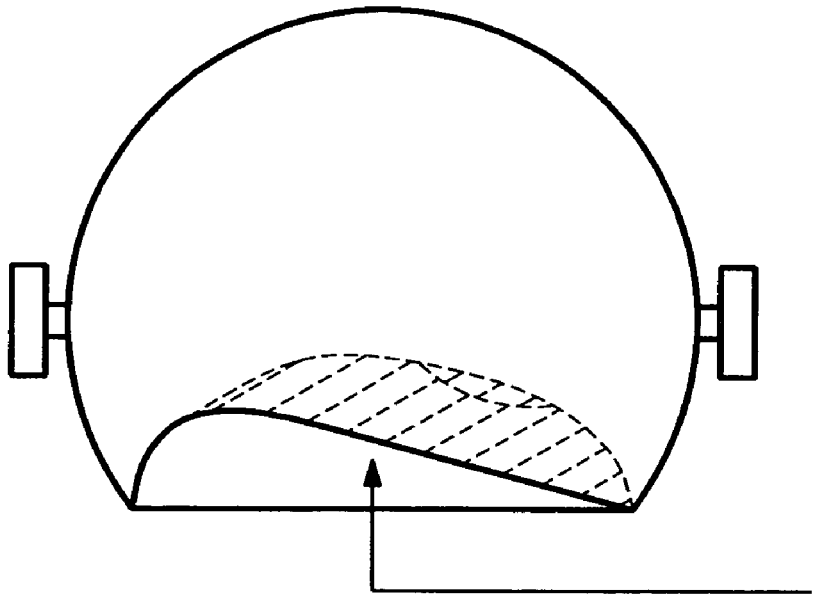
Figure 17C:
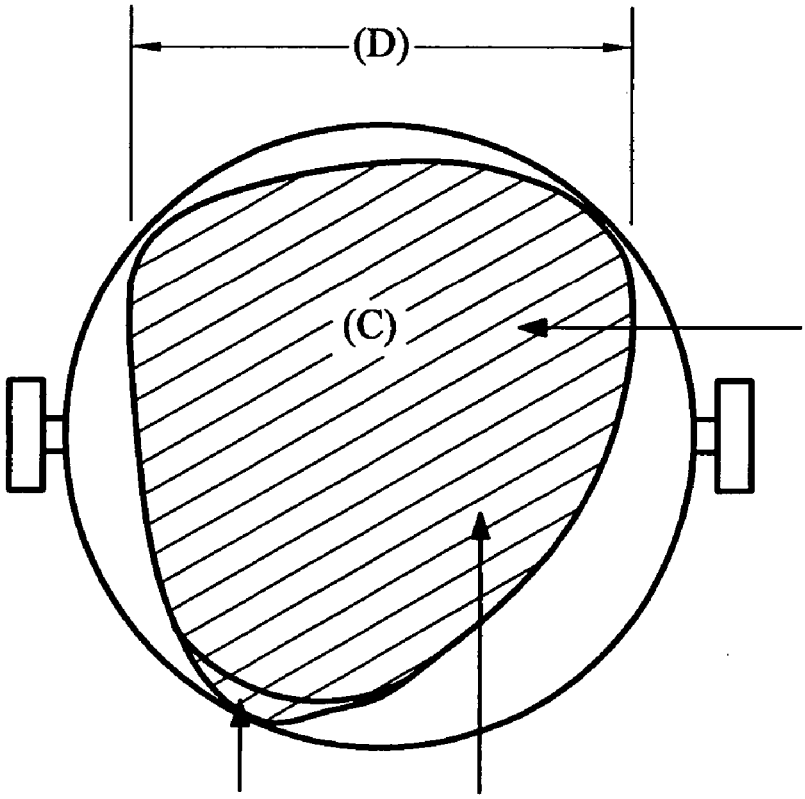

Referring now to the side, front and bottom views of FIGS. 17A–17C, respectively, there is shown a further alternative embodiment of the shaped surface 16 of valve 10. As described above, it is known that turbulent flow of air into cylinder 30 is desirable so that maximum mixing with the injected gas occurs. With purely laminar air flow into the cylinder, the air and the gas tends not to mix as well. Therefore, the embodiment shown in FIGS. 17A–17C, the topography of shaped surface 16 draws air into the cylinder in such a way as to maximize its mixing with the injected gas.

Figure 17D:
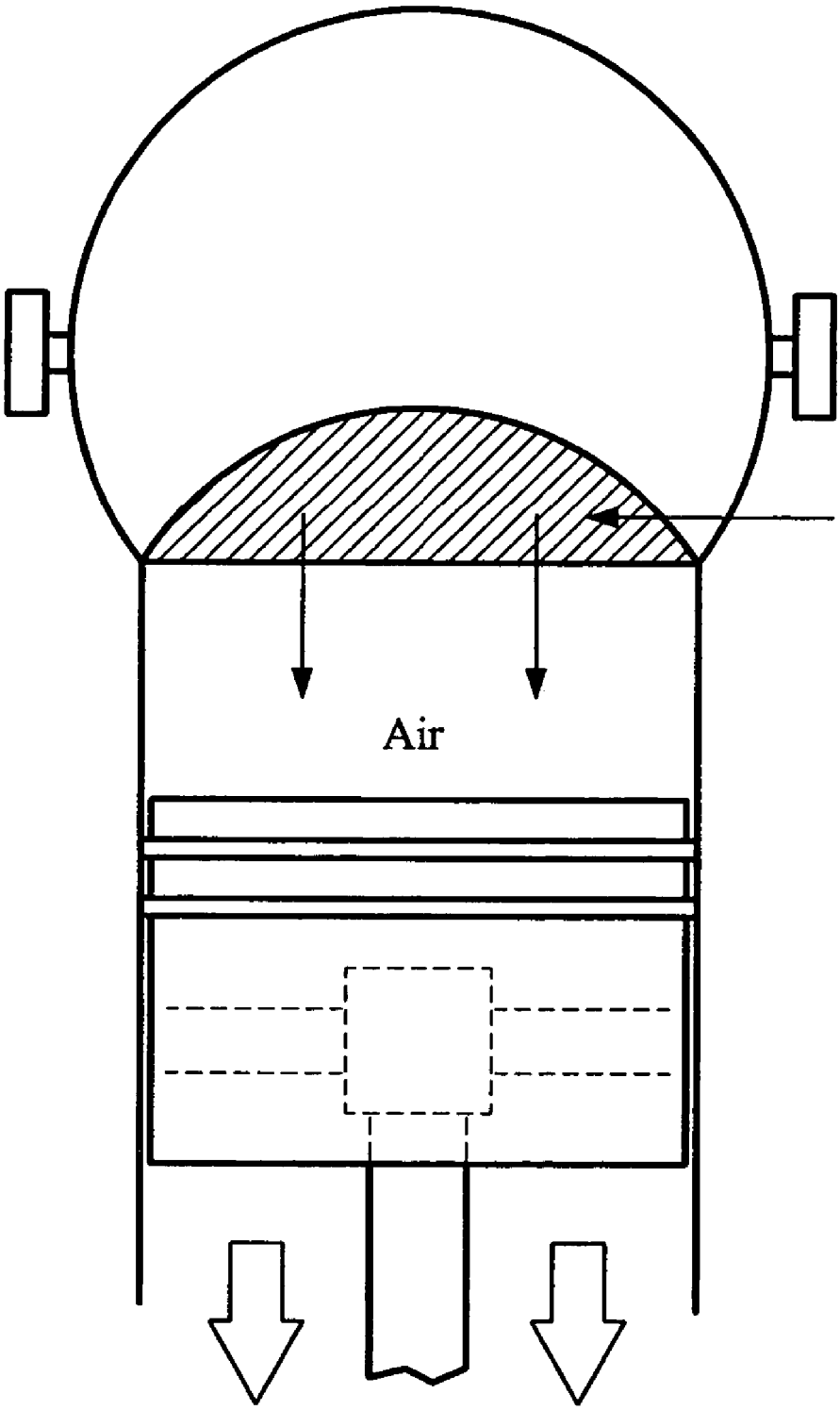
FIGS. 17D–E show the air/gas mixture flow into the cylinder with the spherical rotary valve shown in FIGS. 17A–17C.
Figure 17E:
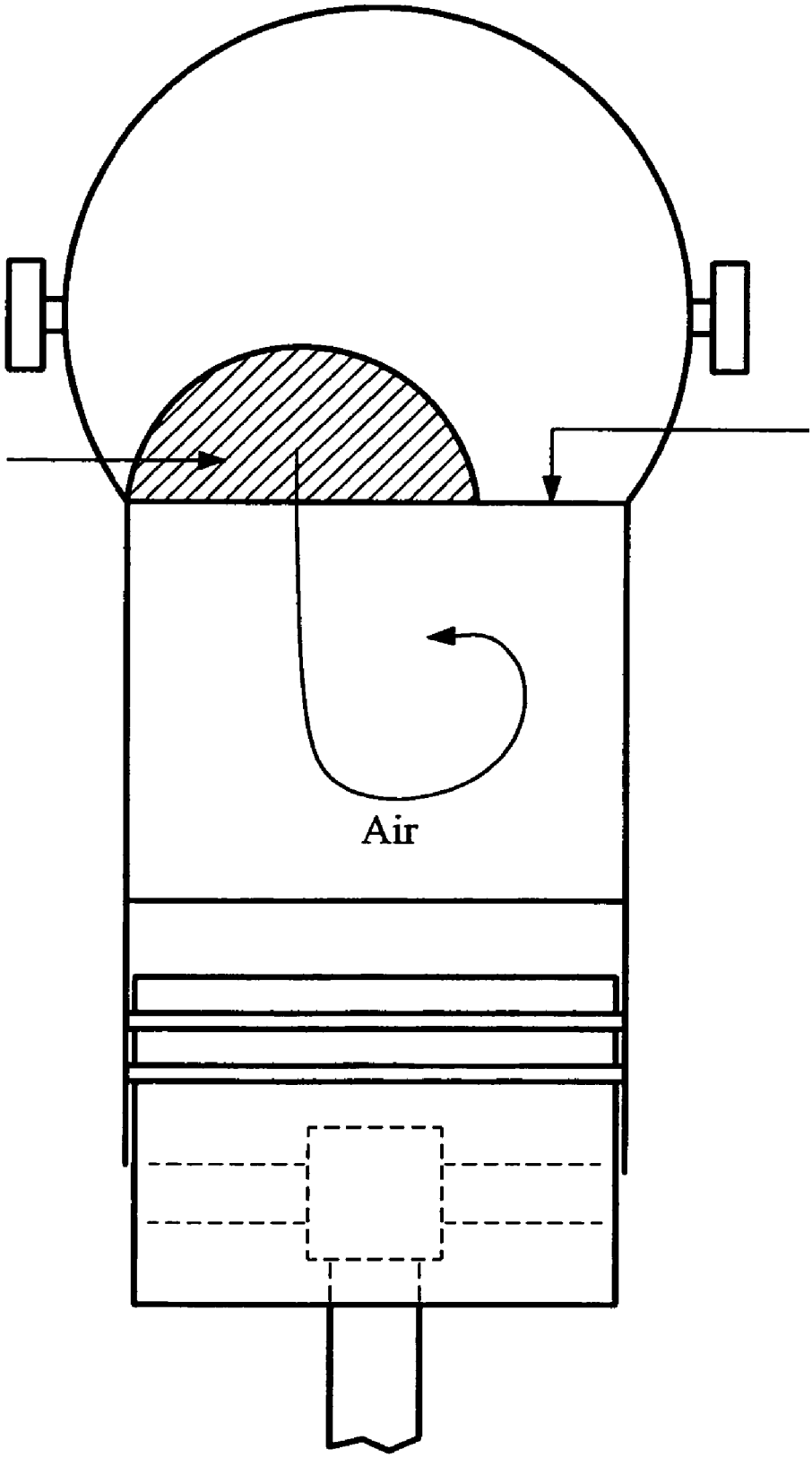
Figure 17F:
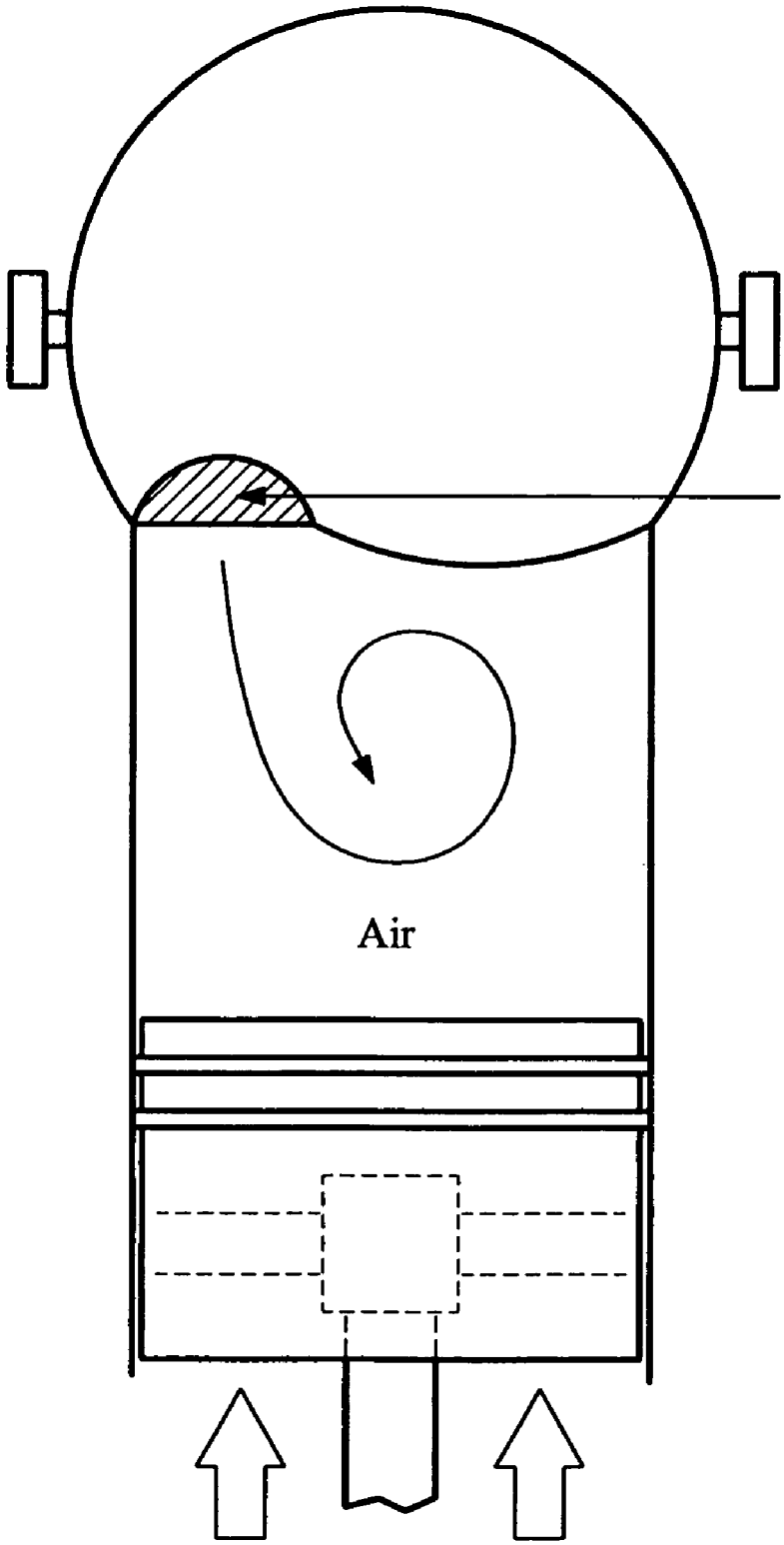

In addition to the convex/concave surface described above, as best seen in the bottom view of FIG. 17C, the shaped surface may further include sidewalls so that the convex/concave surface is formed within a recess in the valve 10. One of the sidewalls, for example the left sidewall (with respect to the view of FIG. 17C) is generally straight relative to a plane perpendicular to the axis of rotation. The opposed right sidewall slopes inward from the convex section 17 to the concave section 13. The effect of this topography is shown in FIGS. 17D–17F. As air is injected into the cylinder 30 and the valve 10 rotates, the topography of the shaped surface 16 closes off air injection to the right side of the cylinder (with respect to the view of FIGS. 17D–17F), while air flow to the left side of the cylinder remains open. Thus, as indicated by the arrow in the cylinder, the air tends to swirl as shown in FIGS. 17E and 17F, thus promoting optimal mixing with the injected gas. As would be appreciated by those of skill in the art, the sloping sidewalls may be reversed in alternative embodiments, so that the left sidewall is straight and the right sidewall slopes inward relative to the view of FIG. 17C.

It is understood that any of the above-described embodiments of the shaped surface 16 of valve 10 may be used with the contoured piston head 90 shown in FIGS. 14A–14E. In alternative embodiments, the various embodiments of the valve 10 may be used with a conventional piston head.

Figure 18:
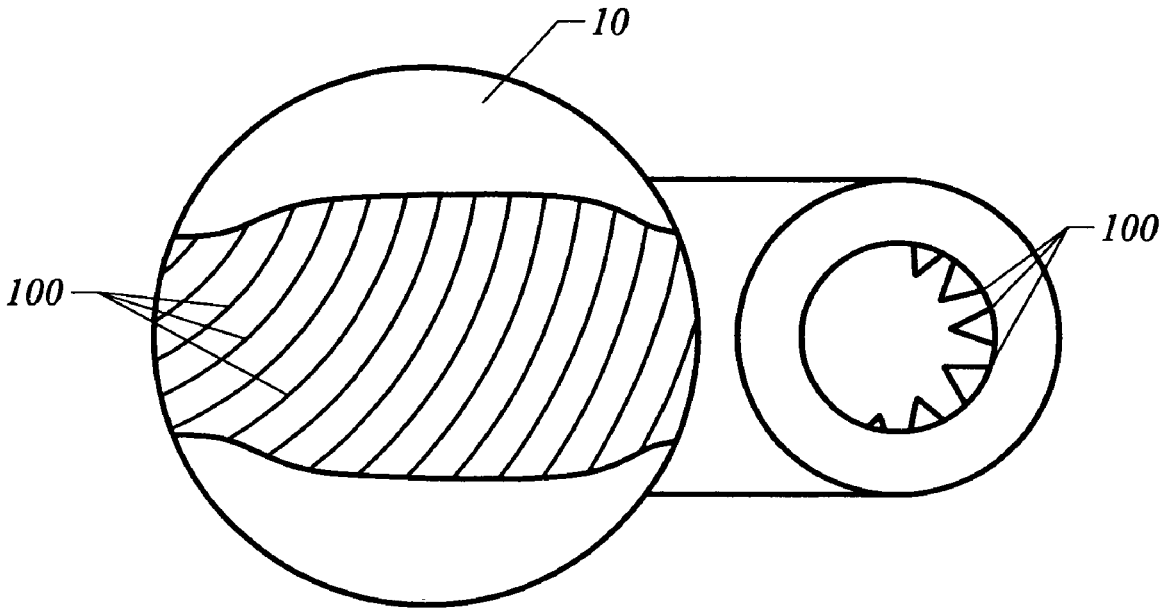
FIG. 18 shows a cross-sectional side view of fins formed within the interior of the valve, with an additional cross-sectional view of the fins shown at the right side of the drawing.

FIG. 18 is a cross-sectional view though the valve into an interior of the valve. The view is a side view so that the shaft (not shown) travels left to right (relative to the view of FIG. 18) through the valve. As previously described, the interior of the valve may include a fluid to promote thermal conductivity. In order to facilitate rotation of the fluid within the valve (relative to the valve), the interior walls of core may have gear-like fins 100 to drive the fluid in one direction by rotational force of the valve. FIG. 18 has an additional cross-sectional view of the fins 100 shown at the right side of the drawing. The rate at which the fluid rotates relative to valve may be controlled by angle of the fins relative to the rotational axis of the valve.

Although the invention has been described in detail herein, it should be understood that the invention is not limited to the embodiments herein disclosed. Various changes, substitutions and modifications may be made to the disclosure by those skilled in the art without departing from the spirit or scope of the invention as described and defined by the appended claims.

I claim:

1. A spherical rotary engine valve assembly for a combustion cylinder in an internal combustion engine, comprising:

a valve mounted for rotation and having a spherical shape with an opening formed within an outer surface of the valve, the opening having a shaped surface including a convex portion and a concave portion;

a seal having a first and second rings for sealing an interface between said valve and the combustion chamber, a force exerted on a portion of said first ring causing a force between said second ring and said valve outer surface; and a contoured piston head formed on a piston operating within the combustion chamber, said contoured piston head having a first concave section generally conforming to a shape of said valve, and a second concave section having a deeper recess than said first concave section.

2. A spherical rotary engine valve assembly as recited in claim 1, further comprising a valve housing positioned adjacent said valve on a side of said valve generally opposite from the cylinder, a gap being defined between said valve and said valve housing, said valve housing including a trench for preventing a flow of gas in a direction within said gap.

3. A rotary engine valve, comprising:

a spherical surface over a majority of said rotary engine valve, said spherical surface capable of substantially sealing the opening to the combustion chamber against fluid flow into or out of the combustion chamber as the spherical surface is positioned over the combustion chamber during rotation of the rotary engine valve; and a shaped section having a surface with a different curvature than said spherical surface, the shaped section including a leading edge and a trailing edge, the leading edge capable of opening to the intake manifold and the combustion chamber before the trailing edge during rotation of the rotary engine valve, said shaped section capable of allowing fluid flow from the intake manifold into the combustion chamber when the leading edge of the shaped section rotates past the intake manifold, portions of the shaped section adjacent the leading edge having a concave shape for enhancing initial volumetric fluid flow from the intake manifold into the combustion chamber as the leading edge rotates past the intake manifold.

4. A rotary engine valve assembly, comprising:

a rotary engine valve rotating about a reference axis, the rotary engine valve capable of sealing an opening to a combustion chamber, and the rotary engine valve capable of allowing fluid flow from an intake manifold into the combustion chamber, the rotary engine valve including:

a spherical surface over a majority of said rotary engine valve, said spherical surface capable of substantially sealing the opening to the combustion chamber against fluid flow into or out of the combustion chamber as the spherical surface is positioned over the combustion chamber during rotation of the rotary engine valve, and a shaped section having a surface with a different curvature than said spherical surface, the shaped section including a leading edge and a trailing edge, the leading edge capable of opening to the intake manifold and the combustion chamber before the trailing edge during rotation of the rotary engine valve, portions of the shaped section adjacent the leading edge having a concave shape for enhancing initial volumetric fluid flow from the intake manifold into the combustion chamber as the leading edge rotates past the intake manifold.

5. A rotary engine valve as recited in claim 4, the rotary engine valve further capable of allowing fluid flow from the combustion chamber to an exhaust manifold, the shaped section capable of allowing fluid flow from the combustion chamber to the exhaust manifold when the leading edge of shaped section rotates past the combustion chamber, the concave shape of the portions of the shaped section adjacent the leading edge capable of enhancing initial volumetric fluid flow from the combustion chamber into the exhaust manifold as the leading edge rotates past the combustion chamber.

6. A rotary engine valve as recited in claim 4, the trailing edge of the shaped section compressing the fluid in the combustion chamber as the trailing edge rotates past the combustion chamber.

7. A rotary engine valve as recited in claim 4, the shaped section getting narrower from the leading edge to the trailing edge for promoting turbulent flow of the fluid entering the combustion chamber.

8. A rotary engine valve assembly as recited in claim 4, the rotary engine valve further capable of allowing fluid flow from the combustion chamber to an exhaust manifold, the concave shape of the portions of the shaped section adjacent the leading edge capable of enhancing initial volumetric fluid flow from the combustion chamber into the exhaust manifold as the leading edge rotates past the combustion chamber.

9. A rotary engine valve assembly as recited in claim 8, further comprising a valve housing generally surrounding the rotary engine valve, a gap being defined between the valve housing and the rotary engine valve, the valve housing including a trench for preventing a flow of fluid within the gap between the exhaust manifold and the combustion chamber.

10. A rotary engine valve assembly as recited in claim 4, the trailing edge of the shaped section compressing the fluid in the combustion chamber as the trailing edge rotates past the combustion chamber.

11. A rotary engine valve assembly as recited in claim 4, further comprising a piston head on a piston reciprocating within the combustion chamber, the piston head including a first concave area generally matching the curvature of the spherical section, and a second concave area having a greater concavity than the first concave area.

12. A rotary engine valve assembly as recited in claim 4, further comprising a seal having a first and second rings for sealing an opening between said spherical portion of the rotary engine valve and the combustion chamber, a force exerted on a portion of said first ring causing a force between said second ring and the spherical portion of the rotary engine valve.

13. A rotary engine valve assembly as recited in claim 4, further comprising an air runner within the intake manifold, the air runner capable of directing fluid to the portions of the shaped section adjacent the leading edge after the leading edge passes by the air runner.

* * * * *